United States Patent [19]

Murphy

[11] Patent Number: 4,728,161

[45] Date of Patent: Mar. 1, 1988

[54] CORNER CABINET

[76] Inventor: Roy D. Murphy, 140 W. Prima Vista Blvd., Port St.Lucie, Fla. 33452

[21] Appl. No.: 888,853

[22] Filed: Jul. 24, 1986

[51] Int. Cl.[4] ..... A47B 97/00

[52] U.S. Cl. ..... 312/238; 312/245; 312/223

[58] Field of Search ..... 312/238, 245, 223; 108/109; 211/87; 248/201, 220.1, 298

[56] References Cited

U.S. PATENT DOCUMENTS

| | | | |
|---|---|---|---|
| 939,005 | 11/1909 | Goedeke | 248/220.1 X |
| 2,313,690 | 3/1943 | White | 312/238 |
| 2,959,368 | 11/1960 | Neff | 312/245 X |
| 2,999,599 | 9/1961 | Jentzen | 312/245 X |
| 3,608,504 | 9/1971 | Peters | 108/109 |
| 3,610,429 | 10/1971 | MacKay | 108/109 X |
| 3,791,709 | 2/1974 | Cross | 312/245 |
| 3,811,745 | 5/1974 | Cylke | 312/245 X |
| 4,066,306 | 1/1978 | Klinder | 312/245 X |
| 4,614,177 | 9/1986 | Buckley et al. | 312/245 X |

*Primary Examiner*—Joseph Falk

*Attorney, Agent, or Firm*—Gilden & Israel

[57] ABSTRACT

A cabinet includes a mounting bracket which permits the attachment of the cabinet in room corners which are out of square. The bracket is adjustably slidable with respect to the cabinet so as to facilitate an attachment of the cabinet to the nonperpendicularly-aligned walls. The cabinet is trapezoidally-shaped to permit its positioning in a corner.

10 Claims, 5 Drawing Figures

CORNER CABINET

BACKGROUND OF THE INVENTION

1. Field of the Invention

The present invention relates to storage cabinets, and more particularly pertains to a new and improved storage cabinet which utilizes a special bracket to facilitate its mounting in a corner formed from walls which are not perpendicularly aligned.

2. Description of the Prior Art

Cabinets which are shaped to fit in room corners defined by the perpendicular alignment of two walls are well known in the art. In this respect, there are numerous patents directed to various designs of such cabinets, and the cabinets can be both free standing or attached to the wall surfaces defining the corner. In many cases, considerable difficulty is experienced in attaching the cabinets because of the fact that the walls forming the corner are not substantially orthogonally aligned. Such a condition can actually prevent attachment of a cabinet in a corner.

As such, it can be appreciated that there exists a continuing need for new and improved cabinets which can be fitted into room corners which are not perfectly square, and the present invention substantially fulfills this need.

SUMMARY OF THE INVENTION

In view of the foregoing disadvantages inherent in the known types of corner cabinets now present in the prior art, the present invention provides an improved corner cabinet construction where the same can be adjustably attached to a corner having walls which are not perfectly perpendicularly aligned. As such, the general purpose of the present invention, which will be described subsequently in greater detail, is to provide a new and improved corner cabinet which has all the advantages of the prior art corner cabinets and none of the disadvantages.

To attain this, the present invention comprises a corner cabinet which is substantially triangularly shaped with the apex of the triangle being positionable in a corner. To facilitate a fit of the cabinet into an out-of-square corner, the apex of the cabinet is replaced by a flat rear wall, whereby the cabinet is more properly defined by a trapezoidal shape. Attached to at least a top surface of the cabinet is a slidable bracket that can be moved into the corner to effect a mounting of the cabinet, with the bracket then being fixedly securable to the cabinet by threaded fasteners. The cabinet may further include a top mounted light, sliding mirrored doors, a towel rack, and adjustable shelves.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved corner cabinet which has all the advantages of the prior art corner cabinets and none of the disadvantages.

It is another object of the present invention to provide a new and improved corner cabinet which may be easily and efficiently manufactured and marketed.

It is a further object of the present invention to provide a new and improved corner cabinet which is of a durable and reliable construction.

An even further object of the present invention is to provide a new and improved corner cabinet which is susceptible of a low cost of manufacture with regard to both materials and labor, and which accordingly is then susceptible of low prices of sale to the consuming public, thereby making such corner cabinets economically available to the buying public.

Still yet another object of the present invention is to provide a new and improved corner cabinet which provides in the apparatuses and methods of the prior art some of the advantages thereof, while simultaneously overcoming some of the disadvantages normally associated therewith.

Still another object of the present invention is to provide a new and improved corner cabinet which has a truncated rear portion to facilitate its attachment to an out-of-square corner.

Yet another object of the present invention is to provide a new and improved corner cabinet which utilizes a slidable, adjustable bracket to facilitate its attachment to an out-of-square corner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
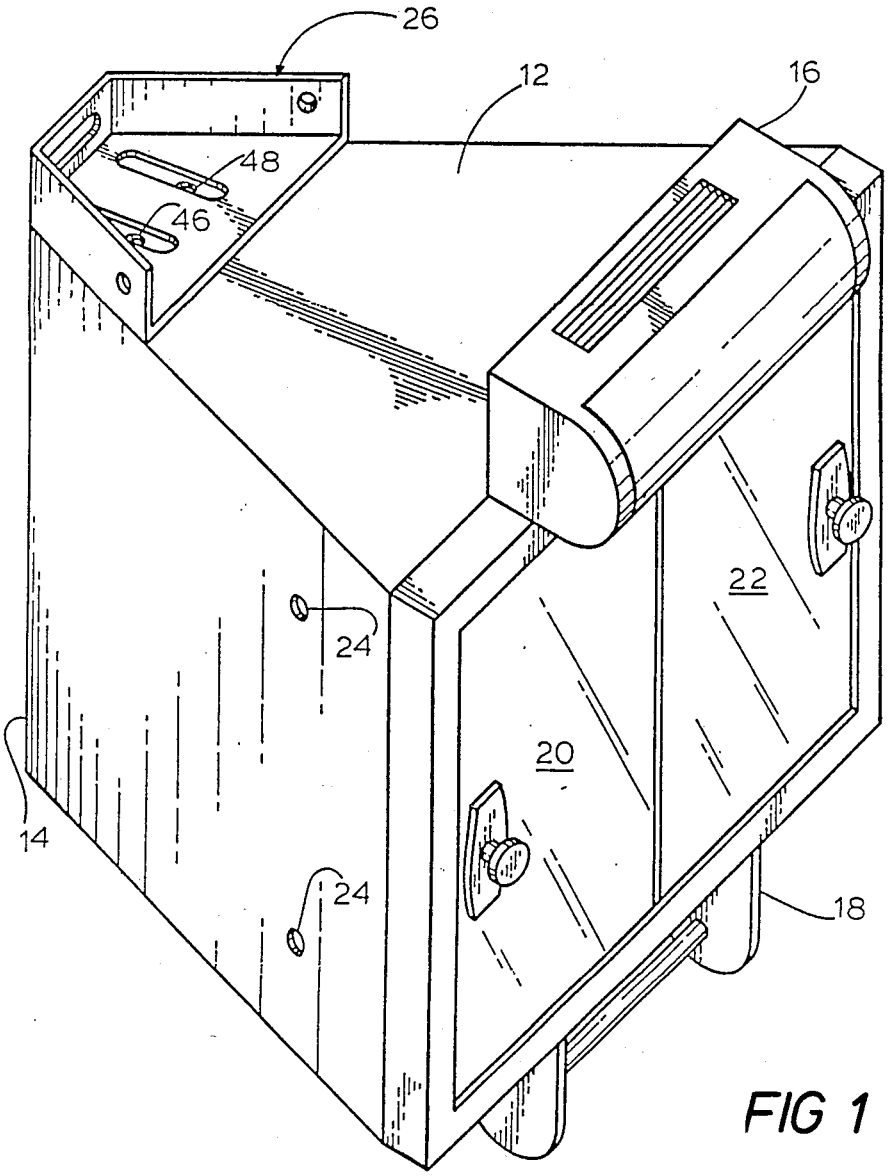
FIG. 1 is a perspective view of the corner cabinet comprising the present invention.

With reference now to the drawings, and in particular to FIG. 1 thereof, a new and improved corner cabinet embodying the principles and concepts of the present invention and generally designated by reference numeral 10 will be described.

More specifically, it will be noted that the corner cabinet 10 essentially comprises a trapezoidally-shaped housing 12 with a rear wall section of the housing 14 being truncated to define the top of the trapezoid. This truncated rear wall portion 14 facilitates a positioning of the cabinet housing 12 into an out-of-square corner.

Various accessories may be attached to the housing 12 to complement a use of the cabinet 10, which such accessories including a topmost mounted light assembly 16 and a bottommost positioned towel rack 18. The cabinet 10 may include interior shelves which are protectively covered by sliding mirror doors 20, 22. Additionally, a plurality of through-extending apertures 24 may be provided in sidewall portions of the cabinet housing 12, and these apertures may be utilized to receive threaded fasteners, nails, or the like, which can be directd into the walls of a corner to thus provide an additional means of mounting the cabinet 10.

Figure 2:
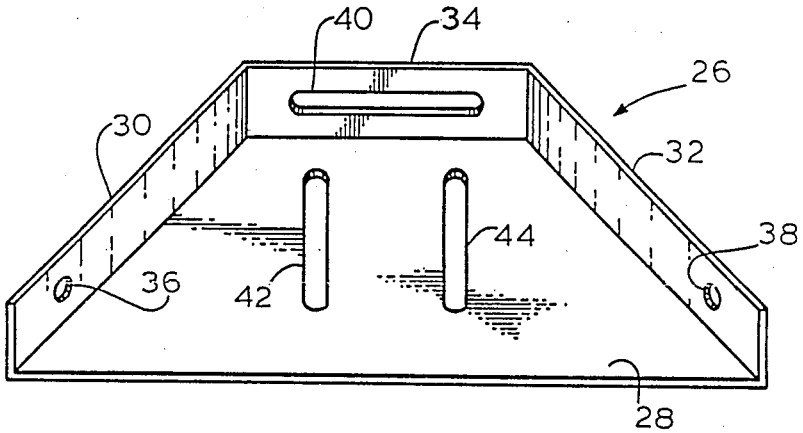
FIG. 2 is a perspective view of the mounting bracket forming a part of the present invention.

Referencing FIG. 2 in conjunction with FIG. 1, it will be noted that a novel feature of the invention 10 includes a corner mounting bracket 26 which facilitates the attachment of the cabinet 10 between non-perpendicularly aligned walls defining a corner. The bracket 26 is of a trapezoidal shape and includes a floor section 28 having upstanding flanges 30, 32, 34 directed around three sides thereof. The flanges 30, 32, 34 would normally be integrally attached to the floor section 28. The flange portions 30, 32 are provided with respective through-extending apertures 36, 38 through which threaded fasteners, or the like, can be directed for attachment to the respective walls of a corner. The flange 34 is provided with an elongated slot 40 through which an additional threaded fastener, or the like, can be adjustably positioned for direct attachment to the corner if additional support of the cabinet 10 is required. The floor portion 28 of the bracket 26 includes a pair of substantially parallelably aligned, elongated slots 42, 44. These slots 42, 44, as best illustrated in FIG. 1, are adjustably alignable with a pair of respective apertures 46, 48 formed in the top of the housing 12. Threaded fasteners can then be directed between the openings 42, 46 and 44, 48 to effect a secure mounting of the bracket 26 to the housing 12.

Figure 3:
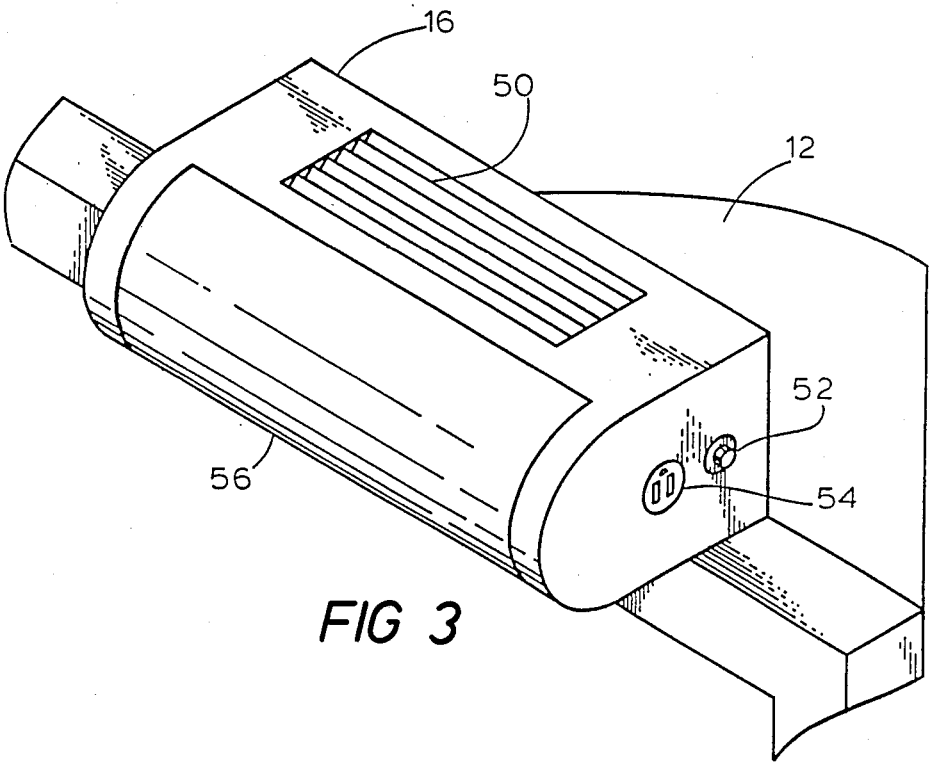
FIG. 3 is a perspective view illustrating the attachment of a light assembly to the cabinet.

FIG. 3 of the drawings has been provided to illustrate the attachment of the light 16 to a topmost portion of the housing 12. As shown, the light 16 would most likely be of an elongated design and would include a topmost positioned vent 50 to facilitate the removal of heat from the light. The light 16 could further include a manually operable on and off switch 52 and an electric plug receptacle 54 which would permit the attachment of other electrically powered appliances thereto. To complete the construction of the light 16, a cylindrically-shaped transparent or translucent lens 56 can be provided to cover the unillustrated light bulb contained therein.

Figure 4:
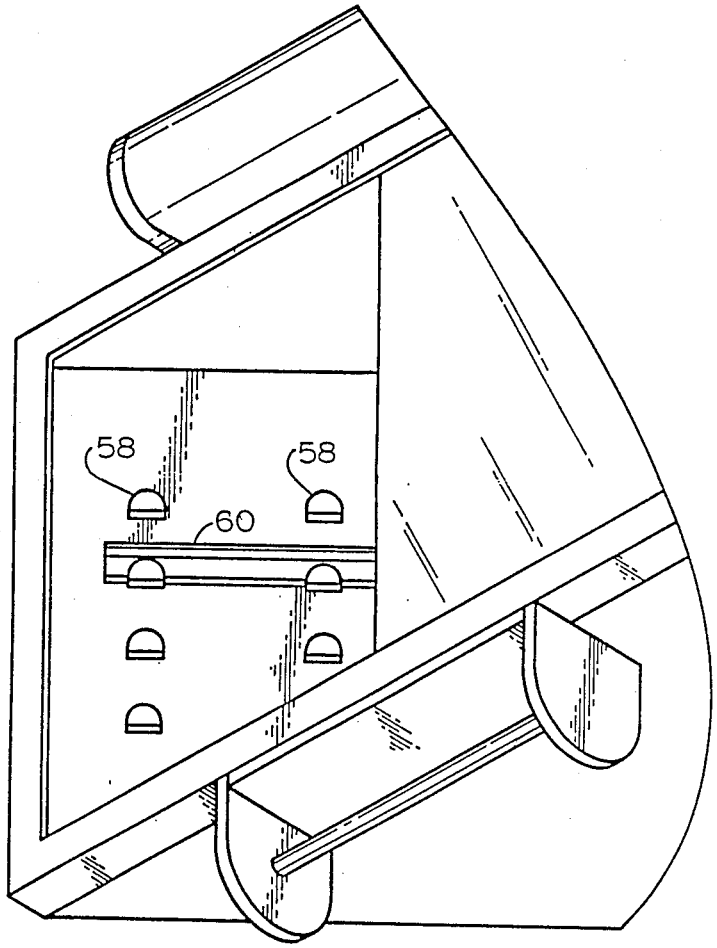
FIG. 4 is an upwardly directed perspective view of the cabinet showing an interior portion thereof.
Figure 5:
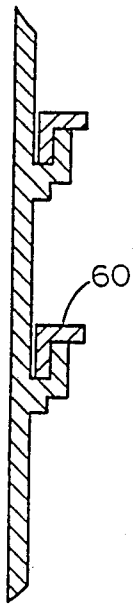
FIG. 5 is a cross-sectional view of a wall portion of the cabinet showing the manner of attaching the shelf support brackets thereto.

FIGS. 4 and 5 of the drawings illustrate the interior construction of the corner cabinet 10, wherein it can be seen that the respective sidewalls of the cabinet may include punched, or otherwise separably attached, upstanding tabs 58. Pairs of the tabs 58 may be positioned at varying heights along a sidewall portion of the housing 12, with L-shaped shelf support members 60 being supportably retained between a selected pair of the tabs. With the support members 60 being positioned on opposed sidewall portions of the housing 12, it can be appreciated that a trapezoidally-shaped shelf, which could be formed of glass, plastic or the like, may then be slid into the cabinet to be retained therein by a pair of the members 60.

With respect to the manner of usage of the corner cabinet 10, the same should be apparent from the above description. However, a brief summary thereof will be provided. More particularly, it can be appreciated that the cabinet 10 can be positioned within a corner having out-of-square walls, and the bracket 26 may then be moved forwardly or rearwardly with respect to the cabinet housing 12 to effect a desired fit within the corner. Once the bracket 26 has been moved to a desired location within the corner, it may be secured to the corner walls by the use of threaded fasteners, or the like, positioned through the apertures 36, 38. With the brackets 26 being adjustably held to a topmost surface of the housing 12 by threaded fasteners extending between the openings 42, 46 and 44, 48, a secure attachment of the cabinet 10 to the bracket 26 can be achieved by tightening the fasteners extending though these openings. Of course, the cabinet housing 12 is first slidably moved relative to the bracket 26 to achieve the best possible fit of the cabinet 10 within the out-of-square corner.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A corner cabinet, comprising:

a. a cabinet housing having two side walls and a roof interconnecting upper portions of said side walls, said roof having inner and outer surfaces, said side walls disposed at such an angle to one another as to facilitate the mounting of said cabinet housing to walls forming a corner;

b. a mounting bracket slidably and adjustably affixed to said outer surface of said roof of said cabinet housing, said mounting bracket comprising a plurality of upstanding flange portions, said upstanding flange portions being partially engageable to said walls forming said corner, said flange portions having means for enabling attachment to said walls forming a corner, said mounting bracket further comprising a mounting bracket floor, said plurality of upstanding flange portions being integrally and substantially orthoganally attached to said mounting bracket floor;

c. a fastening means for slidably and adjustably affixing said mounting bracket to said outer surface of said roof; and, d. at least one elongated fastener receiving slot formed in said mounting bracket floor, said fastener receiving slot being alignable with at least one through-extending aperture formed in said roof of said cabinet housing, said fastening means being positioned through and about said fastener receiving slot and said through-extending aperture to effect a fixed securement of said mounting bracket to said housing.

2. The corner cabinet of claim 1, and further including an additional elongated fastener receiving slot formed in a middle portion of said upstanding flange portions.

3. The corner cabinet of claim 2, and further including shelf supports positioned interiorly of said cabinet housing.

4. The corner cabinet of claim 3, wherein said shelf supports include upstanding tabs fixedly secured to said interior surfaces of said side walls of said cabinet housing.

5. The corner cabinet of claim 4, wherein said shelf supports further include L-shaped members positionable between pairs of said tabs, said L-shaped members serving to support shelves positioned therebetween.

6. The corner cabinet of claim 5, and further including lighting means attached to said cabinet housing.

7. The corner cabinet of claim 6, and further including sliding doors serving as a front wall of said cabinet housing.

8. The corner cabinet of claim 7, wherein said sliding doors include mirrored surfaces.

9. The corner cabinet of claim 8, and further including a towel rack attached to said outside surface of said floor of said cabinet housing.

10. The corner cabinet of claim 9, and further including at least one through-extending aperture formed in said side walls of said cabinet housing, said side wall through-extending aperture facilitating the positioning of a fastener through said cabinet housing into at least one of said walls.

* * * * *